US006962051B2

(12) United States Patent
Radcliff

(10) Patent No.: US 6,962,051 B2
(45) Date of Patent: Nov. 8, 2005

(54) CONTROL OF FLOW THROUGH A VAPOR GENERATOR

(75) Inventor: Thomas D. Radcliff, Vernon, CT (US)

(73) Assignee: UTC Power, LLC, South Windsor, CT (US)

( * ) Notice: Subject to any disclaimer, the term of this patent is extended or adjusted under 35 U.S.C. 154(b) by 0 days.

(21) Appl. No.: 10/463,002

(22) Filed: Jun. 17, 2003

(65) Prior Publication Data

US 2004/0255585 A1 Dec. 23, 2004

(51) Int. Cl.[7] ..... F02G 1/00
(52) U.S. Cl. ..... 60/597; 60/670; 60/671
(58) Field of Search ..... 60/39, 182, 597, 60/670, 671

(56) References Cited

U.S. PATENT DOCUMENTS 3,575,144 A * 4/1971 Takahashi et al. ..... 122/406.1
4,191,021 A * 3/1980 Nakamura et al. ..... 60/657
4,505,123 A * 3/1985 Kusakabe et al. ..... 62/148
4,821,507 A * 4/1989 Bachmann et al. ..... 60/39.182
5,493,854 A * 2/1996 Nielsen ..... 60/783
5,632,143 A * 5/1997 Fisher et al. ..... 60/39.182
6,192,694 B1 * 2/2001 Hiro et al. ..... 62/141

OTHER PUBLICATIONS

Thermodynamics of Waste Heat Recovery in Motor Ships, Professor A.J. Morton, MSc, Manchester University, Mechanical Engineering Dept., Trans I Mar E (C), 1981, vol. 93, Paper C69, pp. 1–7.

* cited by examiner

*Primary Examiner*—Hoang Nguyen
(74) *Attorney, Agent, or Firm*—Wall Marjama & Bilinski LLP

(57) ABSTRACT

In a Rankine cycle system wherein a vapor generator receives heat from exhaust gases, provision is made to avoid overheating of the refrigerant during ORC system shut down while at the same time preventing condensation of those gases within the vapor generator when its temperature drops below a threshold temperature by diverting the flow of hot gases to ambient and to thereby draw ambient air through the vapor generator in the process. In one embodiment, a bistable ejector is adjustable between one position, in which the hot gases flow through the vapor generator, to another position wherein the gases are diverted away from the vapor generator. Another embodiment provides for a fixed valve ejector with a bias towards discharging to ambient, but with a fan on the downstream side of said vapor generator for overcoming this bias.

24 Claims, 3 Drawing Sheets

CONTROL OF FLOW THROUGH A VAPOR GENERATOR

FEDERALLY SPONSORED RESEARCH

The U.S. Government has a paid-up license in this invention and the right in limited circumstances to require the patent owner to license others on reasonable terms as provided for by the term of Contract Nos.: FC02-00CH11060 and FC36-00CH11060 awarded by the Department of Energy.

BACKGROUND OF THE INVENTION

This invention relates generally to Rankine cycle systems and, more particularly, to a method and apparatus for controlling of the flow of a fluid through a vapor generator thereof.

Power generation systems that provide low cost energy with minimum environmental impact, and that can be readily integrated into the existing power grids or rapidly sited as stand alone units, can help solve critical power needs in many areas of the U.S. Gas turbine engines and reciprocating engines are examples of such systems. Reciprocating engines are the most common and most technically mature of these distributing energy sources in the 0.5 to 5 MWe range. These engines can generate electricity at low cost with the efficiencies of 25–40% using commonly available fuels such as gasoline, natural gas, and diesel fuel. However, atmospheric emissions, such as nitrogen oxides (NOx) and particulates can be an issue with reciprocating engines. One way to improve the efficiency of combustion engines without increasing the output of emissions is to apply a bottoming cycle. Bottoming cycles use waste heat from such an engine and convert the thermal energy into electricity. One way to accomplish this is by way of organic Rankine cycle (ORC) power generators, which produce shaft power from lower temperature waste heat sources by using an organic working fluid with a boiling temperature suited to the heat source.

A concern with such use of an ORC is that, if the ORC cycle is interrupted, such as would occur with a failure of a pump, for example, then the refrigerant flow would discontinue and the temperature of the refrigerant within the system would eventually rise to the level of the heat source temperature, which could be well exceed the safe limit of around 350° F. for the refrigerant and cause the refrigerant and/or the lubricant therein to decompose.

Another concern in the design of organic Rankine cycles which use waste heat, is that of corrosion in the boiler. Hot gases from the combustion of natural gases or diesel fuel can be very corrosive if allowed to condense on the heat transfer surfaces of the boiler tubes. Normal practice is to design the boiler such that hot gas exits at 250–350° F., thereby preventing condensation of corrosive exhaust constituents such as sulfuric acid. However, there are times during start up or maintenance when this constraint is not met and condensation and corrosion can occur. Isolation of the boiler from the hot gas stream during these times could prevent condensation, but it is difficult and expensive to produce a high-temperature, low-leakage seal.

In addition to the above needs, there are some circumstances where it is beneficial to be able to divert or reduce the hot gas flow through the boiler. That is, if the exhaust gases being provided to the boiler are substantially in excess of 700° F., which can occur with gas turbine engines, then the refrigerant in the ORC will likely exceed a safe temperature threshold so as to cause decomposition of lubricant in the refrigerant, thereby forming coke which deteriorate boiler performance through excessive boiling and leads to oil loss of the system. Also, the refrigerant itself might decompose when it sees temperatures of excess of 350° F.

It is therefore an object of the present invention to provide an improved boiler heating arrangement for an organic Rankine cycle system.

Another object of the present invention is the provision in an ORC system for preventing excessive refrigerant temperatures in the event of a failure within the ORC system.

Another object of the present invention is the provision in an organic Rankine cycle system for preventing corrosion in a vapor generator/boiler thereof.

Yet another object of the present invention is the provision in the heating portion of an organic Rankine cycle system, for the control of the temperature thereof.

Still another object of the present invention is the provision in an organic Rankine cycle system which is economical to manufacture and effective and efficient in use.

These objects and other features and advantages become readily apparent upon reference to the following description when taken in conjunction with the appended drawings.

SUMMARY OF THE INVENTION

Briefly in accordance with one aspect of the invention in the event of a failure of the ORC refrigerant circulation system the heat source is diverted from the ORC boiler to prevent excessive temperatures.

In accordance with another aspect of the invention, at times when the vapor generator is allowed to cool down to the point where condensation will occur, provision is made for the reverse flow of air therethrough, to ambient, to thereby flush any harmful condensible gases that may be in the vapor generator.

In accordance with another aspect of the invention, a diverter/ejector is placed between the heat source and the ORC, and the ejector is operated such that, during normal operation, the gases flow through the ejector and to the ORC, while at times when the ORC vapor generator temperature will fall below a certain level, the ejector is adjusted such that the exhaust gases flow from the heat source through the ejector and to ambient, while at the same time drawing ambient air through the ORC vapor generator, through the ejector and to ambient to thereby flush out the gases that would otherwise condense in the vapor generator.

By yet another aspect of the invention, the ejector may be adjusted such that during normal operation, when the exhaust gases are flowing through the ejector and through the ORC, ambient air will be drawn in through the ejector and through the ORC, to thereby reduce the temperature of the gases to an acceptable level.

In there drawings as hereinafter described, a preferred embodiment is depicted; however, other various modifications and alternate constructions can be made thereto without departing from the true spirit and scope of the invention.

BRIEF DESCRIPTION OF THE DRAWINGS

For a further understanding of these and other objects of the invention, reference will be made to the following detailed description of the invention which is to be read in connection with the accompanying drawings, wherein.

DESCRIPTION OF THE PREFERRED EMBODIMENT

Figure 1:
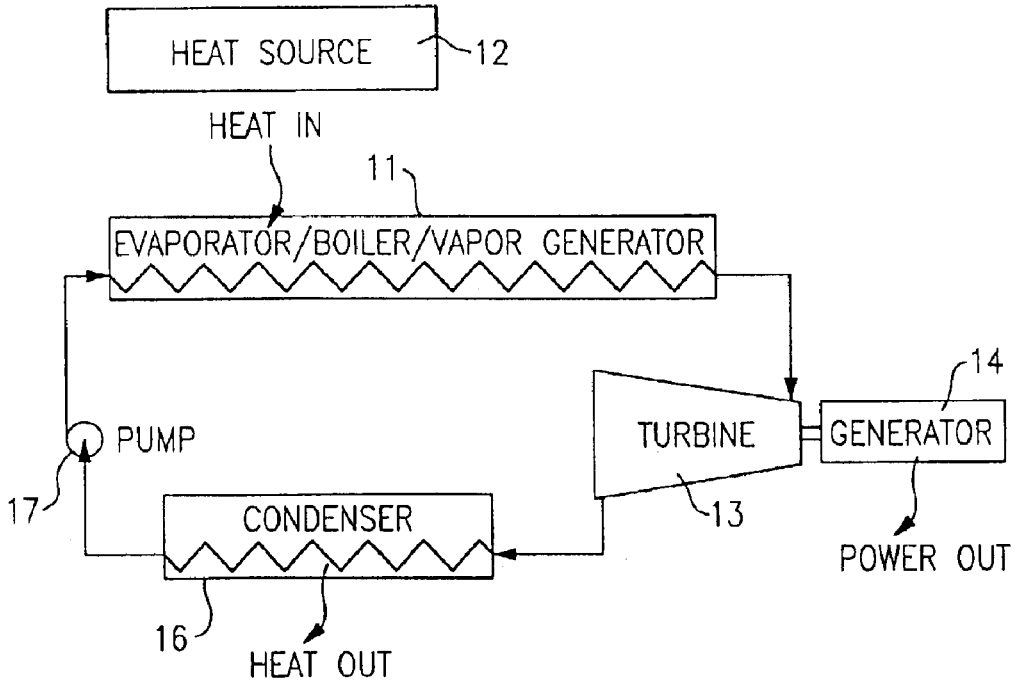
FIG.1 Prior Art
FIG. 1 is a schematic illustration of a Rankine cycle system in accordance with the prior art.

Referring now to FIG. 1, a typical Rankine cycle system is shown to include an evaporator/boiler/vapor generator 11 which receives heat from a heat source 12 to generate high temperature vapor and provide motive power to a turbine 13 which in turn drives a generator 14 to produce power. Upon leaving the turbine 13, the relatively low pressure vapor passes to the condenser 16 where it is condensed by way of heat exchange relationship with a cooling medium. The condensed liquid is then circulated to the evaporator by a pump 17 as shown to complete the cycle. The motive fluid in such Rankine cycle system is commonly water but may also be a refrigerant, in which case it is referred to as anorganic Rankine cycle (ORC).

Figure 3:
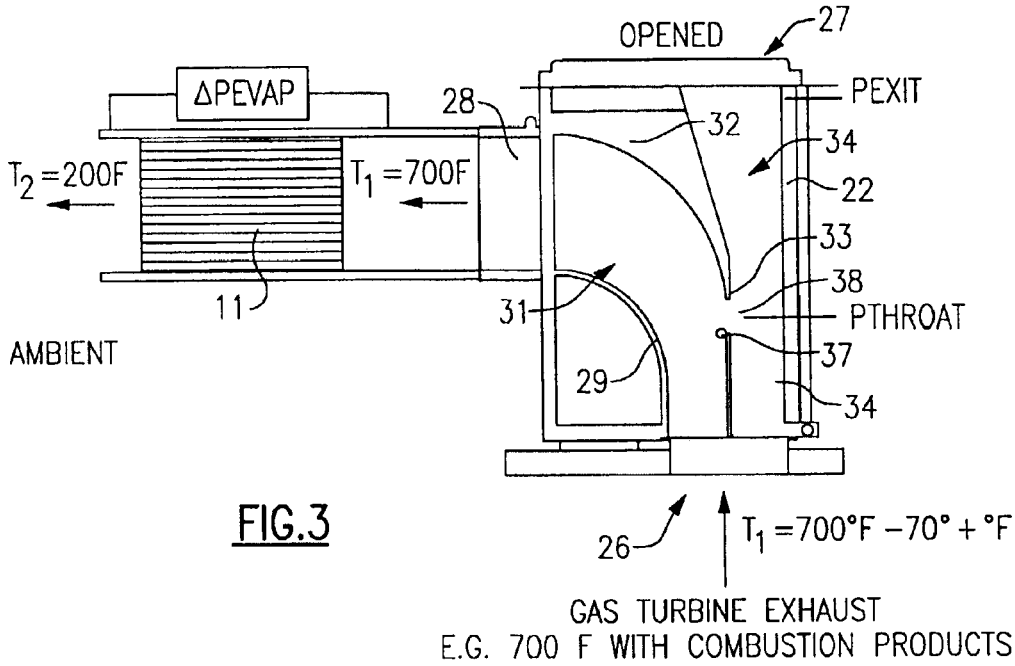
FIG. 3 is a schematic illustration of the ejector as positioned to direct flow during normal operation.
Figure 4:
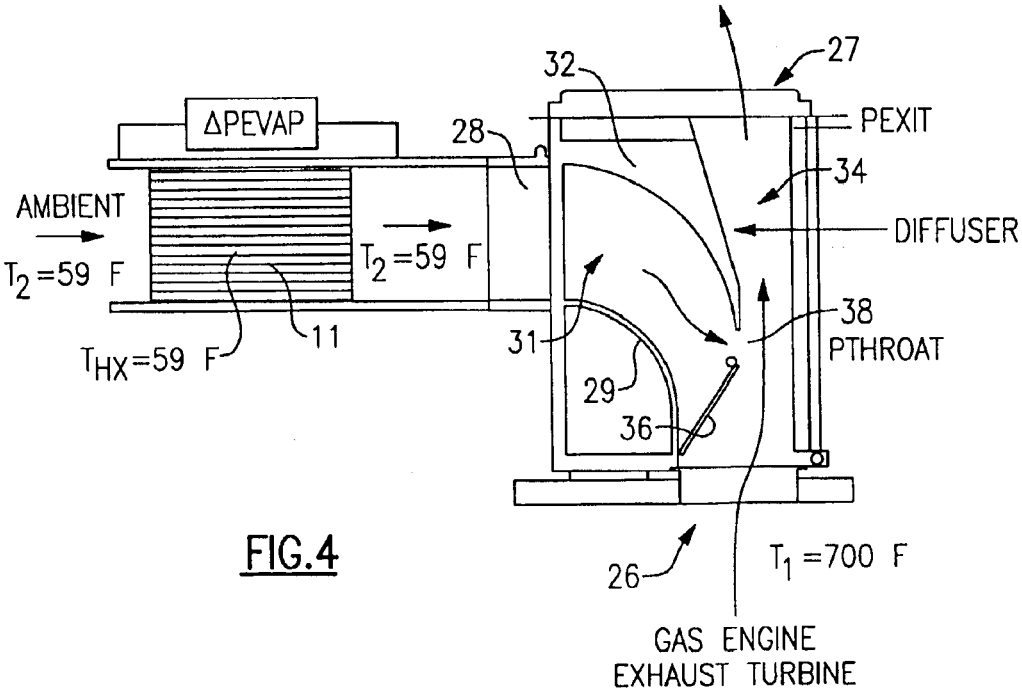
FIG. 4 is a schematic illustration of the ejector as positioned to direct flow when the ORC is at a lower temperature.

Such an organic Rankine cycle system is susceptible to three possible problems. Firstly, if the pump 17 fails, then the temperature of the refrigerant can rise to excessive levels. Secondly, if the gases from the heat source 12 are at too high a temperature, the refrigerant in the vapor generator 11 will be heated to such a degree (e.g., 440° F.), that the lubricant within the refrigerant decomposes. The decomposed lubricant will be changed to coke, which causes a deterioration of the boiler performance as described above. Thirdly, if the vapor generator 11 is caused to have its temperature substantially lowered from its operating temperature, such as when it is shut down for maintenance and the like, any hot gases that are retained or which flow into the vapor generator would tend to condense and form acids that will be detrimental to the structure of the vapor generator 11. All of these problems are addressed by the use of diverter/ejector device as shown in FIGS. 2–4.

Figure 2:
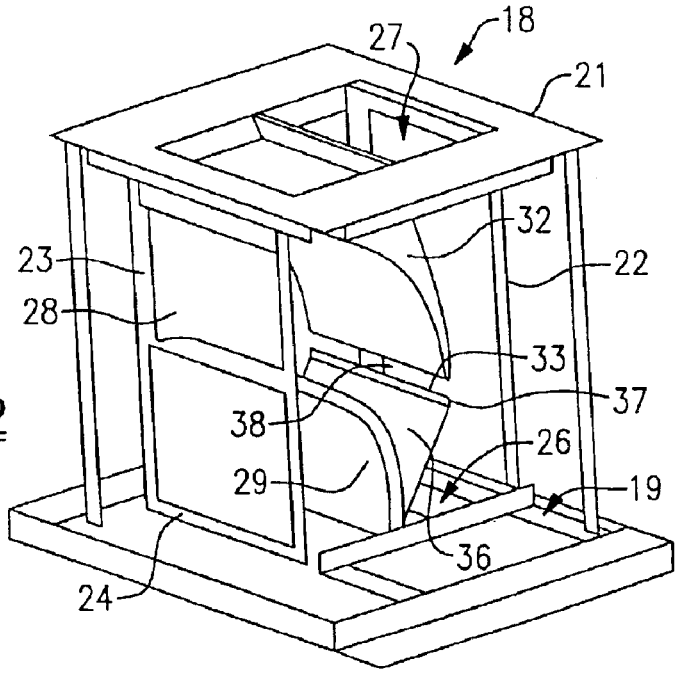
FIG. 2 is a perspective view of the ejector portion of the invention.

One embodiment of the diverter/ejector 18 is shown in FIG. 2. It comprises a box like structure having bottom and top walls 19 and 21, and four side walls, three of which are shown at 22, 23 and 24. Within those walls, there are provided a number of openings including bottom wall opening 26, top wall opening 27, and side wall opening 28. These openings allow for the fluid flow into and out of the diverter 18 as will be described hereinafter.

Within the ejector 18 is a pair of stationary structures. An arcuate wall 29 interconnects the edge of opening 26 with an edge of the opening 28 and defines one side of a flow channel 31 between opening 26 and 28. A flow divider island 32 is mounted adjacent the top wall 21 and side wall 24 and is cantilevered downwardly to a relatively sharp edge 33. This member defines the other side of the flow channel 31 between opening 26 and 28, and also defines, along with wall 22, a flow channel 34 between openings 26 and 27.

Also included within the diverter/ejector 18 is a modulating plate 36 which is rotatably mounted at its top edge 37, near the sharp edge 33. A space 38 is provided between the sharp edge 33 and the top edge 37 for the flow of fluid as will be described hereinafter. The modulating plate 36 is selectively rotated about its upper edge 37 to control the fluid flow within the ejector 18. For example, in FIG. 2, it is moved to a position that shuts off the flow of air from the opening 26 to the flow channel 31. In FIG. 3, it is moved to a vertically aligned position which allows the fluid flow coming into opening 26 to pass on each side of the modulating plate 36 so as to flow into both flow channels 31 and 34.

Considering now the operation of the ejector 18 during normal operation as shown in FIG. 3, hot combustion products (e.g., from a gas turbine exhaust), pass into the opening 26 and, as mentioned above, when the modulating plate 36 is in the vertical position, the gases can flow to both openings 27 and 28. When the modulating plate 36 is moved to the right as indicated by the dotted line, then all of the gases coming into the opening 26 will flow through the flow channel 31 and out the opening 28 to the vapor generator 11. As this occurs, a low pressure area is created in the flow channel 31 such that ambient air is caused to flow into the opening 27, through the flow channel 34, and through the space 38 to enter the flow channel 31. The introduction of this relatively cool air with that of the hot gases coming into the opening 26 causes a reduction in temperature of the gases that flow to the vapor generator 11. In this way, the exhaust gas temperatures which may otherwise be excessive to create problems for the vapor generator as discussed hereinabove, can be avoided. Ideally, temperatures $T_1$ of the gases flowing into the vapor generator 11 are around 700° F., and those leaving the vapor generator 11 are around 200° F. If they are significantly higher, the refrigerant being circulated through the vapor generator will be heated to an excessive temperature that will be harmful to both the refrigerant and the lubricant within. If the temperature $T_2$ is substantially below 200° F., then condensation will tend to occur within the vapor generator 11 to thereby cause corrosive effects. The modulating plate 36 is therefore selectively adjusted in an effort to maintain the ideal temperature relationship.

It should be noted that the structure as shown provide for a fixed distance between the sharp edge 33 and the top edge 37 such that the space 38 remains constant. This distance can be established to meet the design requirements for the particular installation. However, the structure may, as well, be so constructed as to allow for the selective variation of that distance so as to thereby selectively vary the amount of ambient air that flows into the system during normal operation.

Considering now the situation where an ORC system failure occurs, such as a failure of the pump 17, the reduced flow is sensed by a flow sensor 40 and, in response the modulating plate 36 is then moved to the closed position as shown in FIG. 2, such that all of the hot gases are diverted to flow upwardly to ambient air. This prevents the refrigerant in the ORC from being heated to excessive temperatures. Instead of a flow sensor 40, a temperature sensor (not shown) can be installed in the vapor generator to sense temperatures that exceed a predetermined threshold level to activate the diverter.

Considering now the operational condition wherein the vapor generator 11 will be under temperature conditions which would cause condensation of gases therein, care must be taken to prevent such condensation. This would occur, for example, during periods of maintenance and start up. As shown in FIG. 4, during these operating conditions, the modulating plate 36 is moved to the far left position as shown to block off all flow of exhaust gases to the flow channel 31. The exhaust gases will instead flow into the opening 26, through the flow channel 34 and out the top wall opening 27 to ambient. Because of the low pressure condition that is created within the flow channel 34, some of the fluid from flow channel 31 will be drawn in through the space 38 and into the flow channel 34. In doing so, ambient air will be drawn in from the downstream side of the vapor generator 11 to thereby flush out any harmful gases that would otherwise remain in the vapor generator and which could condense to cause harm thereto.

Figure 5:
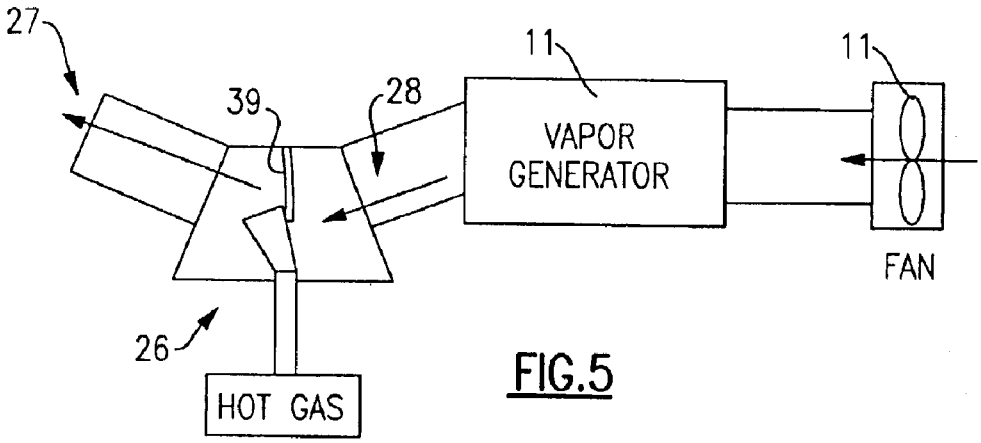
FIGS. 5 and 6 show alternate embodiments of the present invention.
Figure 6:
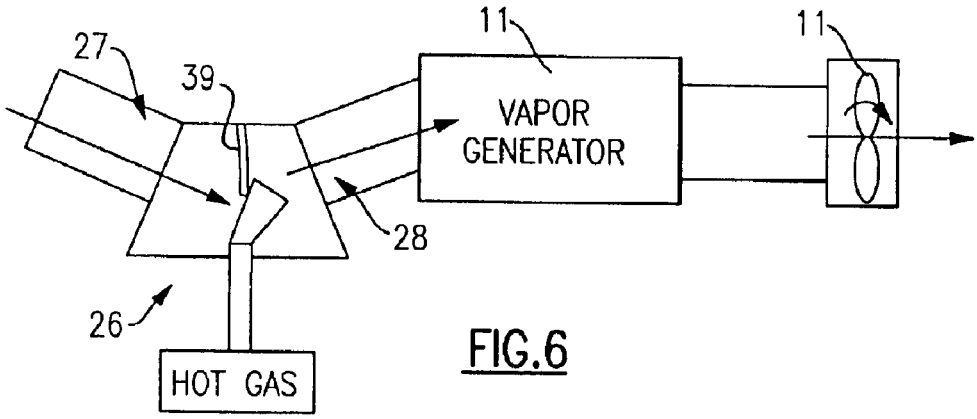

Another embodiment of the present invention is shown in FIGS. 5 and 6 wherein a fixed flap 39 is shown between the openings 26, 27 and 28. There, rather than having a modulatable flap, a fan 41 is provided at the downstream side of the vapor generator 11 as shown. In FIG. 5, the system is shown in the condition wherein the vapor generator 11 is in a cooled condition, such that hot gases need to be flushed from the vapor generator 11. Because the fixed flap 39 is in a biased position which causes the hot gases flowing into the opening 26 to pass out the opening 27 to ambient, the low pressure condition caused by that flow will cause air to be drawn to the left of the opening 28 such that a combustion gases in the vapor generator 11 are drawn out to the opening 27. Thus, the fan 41 is in the off position and air will be drawn to the left as shown by the arrow.

In the full operating condition as shown in FIG. 6, because of the bias of the fixed flap 39 as mentioned above, it is necessary to create a low pressure condition on the downstream side of the vapor generator 11 in order to pull the hot gases away from the ambient opening 27 such that they will flow through the opening 28 to the vapor generator 11. The fan 41 is therefore made to operate as shown so as to pull the flow of combustion gases to flow through the vapor generator 11.

While the present invention has been particularly shown and described with reference to the preferred mode as illustrated in the drawings, it will be understood by one skilled in the art that various changes in detail may be effected therein without departing from the spirit and scope of the invention as defined by the claims.

I claim:

1. A system for converting waste heat into power comprising:

a Rankine cycle system including a vapor generator, a turbine and a condenser fluidly interconnected for serial flow of a fluid therethrough;

said vapor generator being in heat exchange relationship with a flow of hot gases from a waste beat source;

said turbine being adapted for receiving hot vapor from said vapor generator and converting its energy into motion;

said condenser being adapted for receiving cooled vapor from said turbine and converting it to a liquid to be returned to said vapor generator; and a flow diverter disposed in a fluid flow path between said heat source and said vapor generator said flow diverter being adapted for selectively diverting said flow of hot gases from flowing to said vapor generator and simultaneously causing the flow of ambient air through said vapor generator.

2. A system as set forth in claim 1 wherein said flow diverter is adapted to shut off substantially all flow of hot gases to said vapor generator.

3. A system as set forth in claim 1 wherein said flow diverter is adapted to divert said flow of hot gases to ambient.

4. A system as set forth in claim 1 wherein said flow diverter is adapted to cause ambient air to flow in a reverse direction from normal operation.

5. A system as set forth in claim 1 wherein said diverter has three openings, one for the flow of exhaust gases into the diverter, one for the flow of exhaust gases out of the diverter to the vapor generator, and one that provides fluid flow interconnection to ambient.

6. A system as set forth in claim 1 wherein said diverter includes a modulating valve for selectedly causing exhaust gases to flow through said vapor generator when in one position and for causing ambient air to flow through said vapor generator when in another position.

7. A system as set forth in claim 1 wherein said diverter includes a modulating valve which is selectably positionable to provide for the flow of ambient air through said vapor generator.

8. A system as set forth in claim 1 wherein said diverter includes a modulating valve which is selectably positionable to provide for the flow of air from said vapor generator through said diverter and to ambient.

9. A system as set forth in claim 1 wherein said diverter includes a fixed valve member which is biased to cause the flow of hot gases to flow to ambient and to thereby draw ambient air through said vapor generator in the process.

10. A system as set forth in claim 9 and including a fan on a downstream side of said vapor generator which, when caused to operate, will overcome the bias of said valve and cause said hot gases to flow through said vapor generator and to drawn in ambient air in the process.

11. A system as set forth in claim 1 wherein said vapor is a refrigerant.

12. A system as set forth in claim 1 and also including a pump for circulating said condensate back to said generator.

13. A system as set forth in claim 1 wherein said diverter is a bistable type wherein, in one position, it causes hot gases to flow through said vapor generator, while in the other position it causes ambient air to flow therethrough.

14. A method of preventing corrosion in a vapor generator which is generally adapted to receive hot gases from a beat source and to discharge gases at a relatively high temperature but at times is caused to be in a relatively cool state such that gases therein would tend to condense and cause corrosion, comprising the steps of:

providing an ejector between said heat source and said vapor generator; and operating said ejector to cause the flow of hot gases to flow from said heat source, through said ejector, to ambient and in doing so to also cause the flow of ambient air to flow through said vapor generator, through said ejector and to ambient.

15. A method as set forth in claim 14 wherein said flow of air that is caused to flow through said vapor generator is ambient air.

16. A method as set forth in claim 14 wherein said step of causing the flow of hot gases to flow from said heat source through said ejector to ambient is caused by a bistable valve which is the flow path within the said ejector.

17. A method as set forth in claim 14 wherein said step of causing the flow of hot gases to flow from said heat source through said ejector to ambient is caused by a fixed valve within said ejector, with said valve being in a position to bias the flow toward ambient.

18. A method as set forth in claim 17 and including a fan located downstream of said vapor generator and including the further step of activating said fan to overcome the bias and cause the hot gas to flow through said ejector and to said vapor generator.

19. A method of preventing excessive temperatures in a vapor generator of a Rankine cycle system adapted to receive hot gas flow from a heat source, comprising the steps of:

providing a diverter valve between said heat source and said vapor generator;

sensing when the refrigerant flow in said vapor generator reaches a predetermined lower threshold; and responsively operating said diverter valve to shut off the hot gas flow to said vapor generator.

20. A method as set forth in claim 19 wherein said diverter has an opening that fluidly connects to ambient.

21. A method as set forth in claim 20 wherein, when said diverter is shut off, it diverts the hot gas flow to said opening.

22. A system as set forth in claim 1 and including means for sensing when vapor flow in said vapor generator reaches a predetermined lower threshold and responsively causing said flow diverter to divert said flow of hot gases from flowing to said vapor generator.

23. A system as set forth in claim 1 wherein said flow diverter has an opening that fluidly connects to ambient.

24. A method as set forth in claim 14 and including the step of sensing when the vapor flow in said vapor generator reaches a predetermined lower threshold and responsively opening said ejector.

* * * * *